US007654124B2

(12) United States Patent
Knaup

(10) Patent No.: US 7,654,124 B2
(45) Date of Patent: Feb. 2, 2010

(54) METHOD OF MAKING A SHEET METAL PART FOR MOTOR VEHICLES

(75) Inventor: Hans-Jürgen Knaup, Bad Lippspringe (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 0 days.

(21) Appl. No.: 11/831,063

(22) Filed: Jul. 31, 2007

(65) Prior Publication Data

US 2008/0053184 A1 Mar. 6, 2008

(30) Foreign Application Priority Data

Aug. 31, 2006 (DE) ..... 10 2006 040 893

(51) Int. Cl.
*B21D 11/02* (2006.01)
*B21D 11/00* (2006.01)

(52) U.S. Cl. ..... 72/296; 72/303; 72/322

(58) Field of Classification Search ..... 72/295, 72/296, 298, 300, 308, 309, 350, 361, 383, 72/422, 312–314, 319–323, 417–421, 301, 72/303, 311, 322

See application file for complete search history.

(56) References Cited

U.S. PATENT DOCUMENTS

| | | | | |
|---|---|---|---|---|
| 3,838,590 | A * | 10/1974 | Van Dijk | 72/307 |
| 3,908,428 | A * | 9/1975 | MacKenzie | 72/296 |
| 4,077,813 | A | 3/1978 | Fletcher et al. | |
| 4,803,879 | A * | 2/1989 | Crawford | 72/322 |
| 5,572,896 | A * | 11/1996 | Story | 72/350 |
| 2003/0000606 | A1 * | 1/2003 | Muller et al. | 148/624 |
| 2004/0265536 | A1 * | 12/2004 | Sana et al. | 428/119 |

FOREIGN PATENT DOCUMENTS

DE 103 34 483 B4 3/2005

* cited by examiner

*Primary Examiner*—Dana Ross
*Assistant Examiner*—Teresa M Bonk
(74) *Attorney, Agent, or Firm*—Henry M. Feiereisen; Ursula B. Day

(57) ABSTRACT

In a method of making a sheet metal part for motor vehicles, a blank is placed with its opposite length sides between outer lower forming jaws of a die. The blank is then clamped by moving the outer lower forming jaws toward one another. Outer upper forming jaws are then moved to their closed position so that the length sides of the blank are secured in place between the lower and upper forming jaws. The lower and upper forming jaws and a press tool are then moved toward one another, and the blank is shaped to its final configuration to produce a sheet metal part.

12 Claims, 2 Drawing Sheets

METHOD OF MAKING A SHEET METAL PART FOR MOTOR VEHICLES

CROSS-REFERENCES TO RELATED APPLICATIONS

This application claims the priority of German Patent Application, Ser. No. 10 2006 040 893.4, filed Aug. 31, 2006, pursuant to 35 U.S.C. 119(a)-(d), the content of which is incorporated herein by reference in its entirety as if fully set forth herein.

BACKGROUND OF THE INVENTION

The present invention relates to a method of making a sheet metal part for motor vehicles.

Nothing in the following discussion of the state of the art is to be construed as an admission of prior art.

Heretofore, sheet metal parts for motor vehicles, also of relatively uniform profile and slight curves, with or without blank holders, are produced on a large scale using drawing or press forming processes. This is applicable for cold forming as well as press hardening of the sheet metal parts which are hot formed in a cooled die at initial temperatures of above 900° C. and then allowed to cool down in the die to harden.

As the advance of the blank into the press tool varies in dependence on many factors, the position of edges to be cut fluctuates greatly so that most parts require subsequent edge trimming. Also the position and shape of holes introduced into the blank beforehand fluctuates widely so that oftentimes there is a need for re-perforation.

Subsequent trimming and perforating is unwanted in particular when hot formed and press hardened parts are involved. In addition to the need for a separate working step which is not easy to integrate in the manufacturing process for hot formed hardened parts, mechanical trimming of hardened metal sheets exposes tools and machineries to substantial strain which causes significant wear. Moreover, trimming requires also additional material supply. Also, the thickness of the metal sheet and the outline of the edge being cut limits the application of technical and economical options for mechanical cutting, or requires cutting by thermal means, e.g. laser cutting. Finally, the strength of edges that have been cut mechanically and also thermally is impaired and is prone to fissure as a result of microcracks, notches and hardening.

It would therefore be desirable and advantageous to provide an improved method of making a metal sheet for motor vehicles to obviate prior art shortcomings.

SUMMARY OF THE INVENTION

According to one aspect of the present invention, a method of making a sheet metal part for motor vehicles includes the steps of placing a blank with its opposite length sides between outer lower forming jaws of a die, clamping the blank by moving the outer lower forming jaws toward one another, moving outer upper forming jaws to their closed position to thereby secure the length sides of the blank between the lower and upper forming jaws in place, moving the lower and upper forming jaws and a press tool toward one another, and shaping the blank to its final configuration to produce a sheet metal part.

As a result of this method, a sheet metal part is produced with defined length edge regions of high quality. There is no longer any need for subsequent cutting along the length sides or subsequent perforating. As the length sides of the blank are fixed in place between the outer lower and upper forming jaws, the blank is exactly positioned so that the blank cannot shift during the shaping process. In other words, any relative movements between the operative elements of the die and the blank are prevented or insignificant. As a consequence, wear, scoring, abrasion of a coating and baking thereof and depositing in the die are decreased. Also, the need for a forming gap required during drawing and press forming is eliminated. Thus, air cannot get trapped between ram and female mold and contact between the metal sheet and a cooling die is maintained. In cold forming of high strength steel, a curving of the profile is no longer experienced and any recoil of the profile can easily be compensated by overbending.

In particular, when hot forming is involved, the finished part can be formed with very small radii. As a result, available installation space can be better utilized and vehicle weight can be saved.

Unlike conventional drawing or press forming operations, the method according to the invention allows the production of undercut sheet metal parts which have sufficient elasticity to enable their stripping from the ram. No additional working step is required. Demolding of parts with slight undercut can be implemented by simply bending the elastic region. Greater undercuts merely require providing the ram with a demolding mechanism, e.g. a so-called filling slide.

According to another feature of the present invention, the blank can be shaped about a ram of the press tool. Although excess material is formed during the shaping operation between the participating shaping elements of the die, i.e. forming jaws and ram, this is acceptable because excess material can be eliminated during shaping.

According to another feature of the present invention, the blank may be placed between stops in the lower forming jaws, when the blank is clamped in the lower forming jaws. In the event, a positioning of holes in the blank takes precedent, the blank can be secured in the lower forming jaws by pins which enter the holes.

According to another feature of the present invention, the blank may be clamped in midsection in the press tool before or during the initial phase of the actual shaping process.

According to another feature of the present invention, the lower and upper forming jaws can be moved in a direction of the press tool and in a vertical direction thereto. Suitably, the movement of the upper and lower forming jaws in relation to the press tool is executed at the same time. This can be realized by locking the upper and lower forming jaws to one another. The movement of the lower and upper forming jaws may be realized along a curved path. It is also possible to implement the closing movement of the lower and upper forming jaws by means of wedge-shaped sliders and along a straight line.

In accordance with the present invention, the sheet metal part may be hot formed or cold formed. When hot forming in the press tool is involved, the sheet metal part may be hardened, at least in part.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
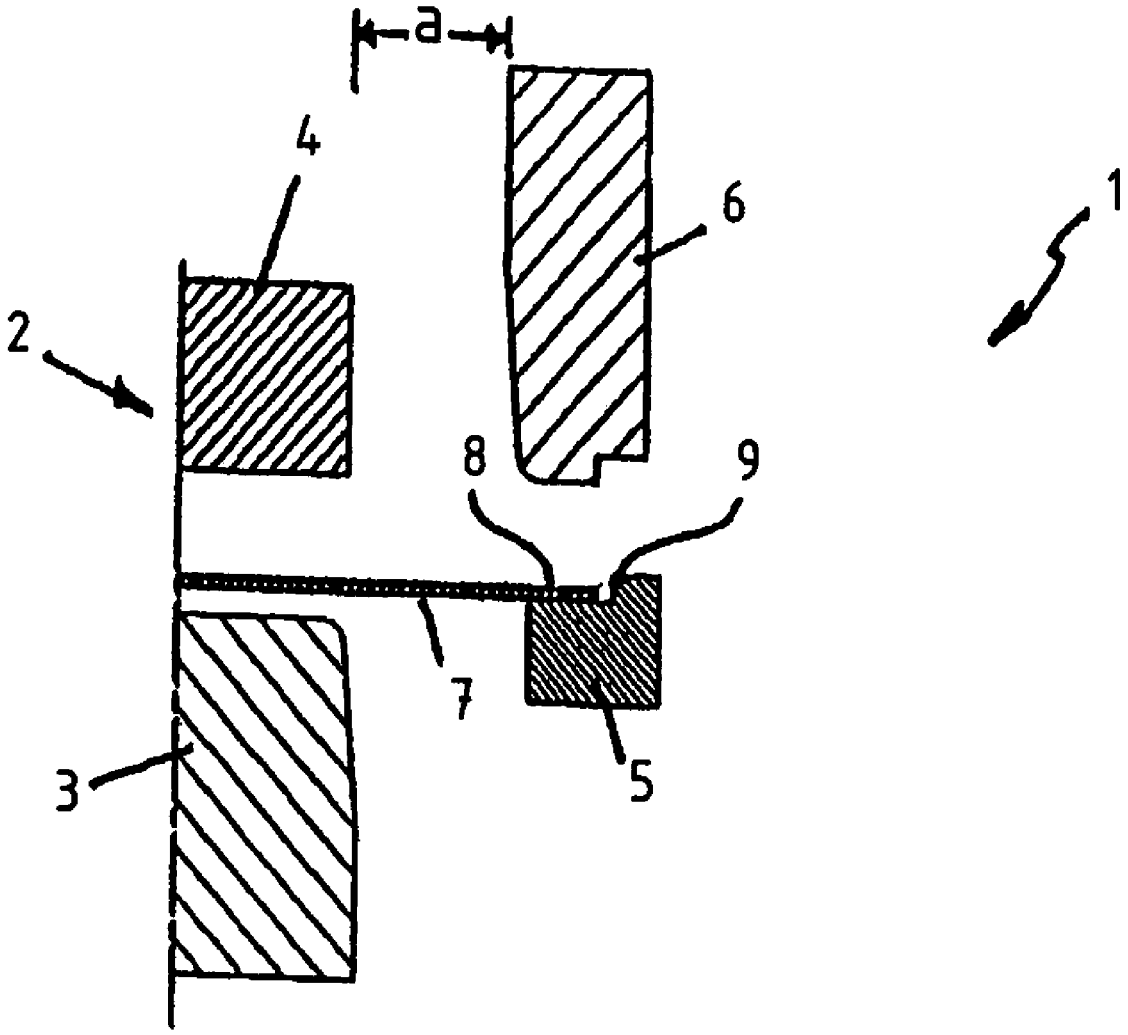
FIGS. 1-7 illustrate schematically, in cross section, a die to carry out a process of making a sheet metal part in accordance with the present invention, showing various process stages of the shaping operation.

Throughout all the Figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to FIGS. 1-7, there are illustrated schematically, in cross section, a die, generally designated by reference numeral 1, for carrying out a process of making a sheet metal part in accordance with the present invention. For convenience and sake of simplicity, the following description is made only in relation to one side of the die 1 (here the right side), when in fact the two sides of the die 1 are mirror images of one another about an imaginary vertical medial plane which bisects the left from the right of the die 1. The die 1 may be a cold forming tool as well as a hot forming tool with integrated cooling.

The die 1 includes a press tool, generally designated by reference numeral 2 and having a lower ram 3 and an upper hold-down clamp 4 as well as outer lower forming jaws 5 and outer upper forming jaws 6. In idle position, when the die 1 is open, the forming jaws, 5, 6 are arranged at a distance "a" to the press tool 2.

Figure 2:
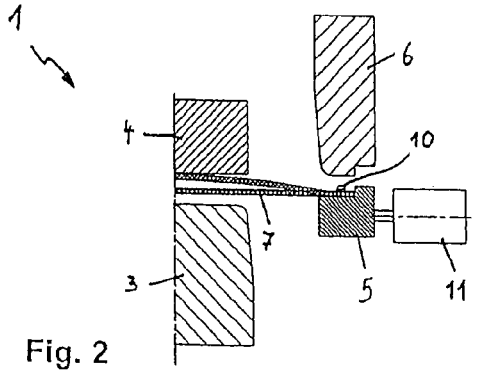

FIG. 1 shows the initial phase of the shaping process, in which a blank 7, e.g. of steel sheet, is placed with its length sides 8 between shoulder-type stops 9 in the lower forming jaws 5. The length sides 8 define later the contour or length edges of the finished sheet metal part. In the event, the blank 7 is perforated and the disposition of the holes should be maintained in geometrically accurate manner in the finished sheet metal part, the lower forming jaws 5 are provided with pins 10 that come into registry with the holes for fixing the holes in place, as shown in FIG. 2.

The lower forming jaws 5 are then uniformly moved inwards by a slider or hydraulic or electric servo drive 11 until the blank 7 is clamped between the stops 9 or secured in place via the pins 10 in the holes. To ensure a secure contact, a slight arching of the blank 7 is accepted, as shown in FIG. 2.

Figure 3:
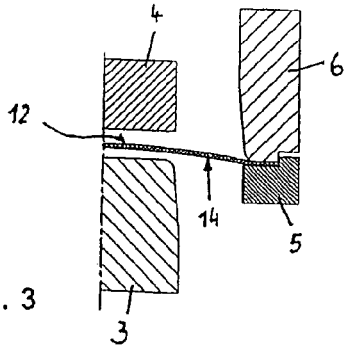
Figure 4:
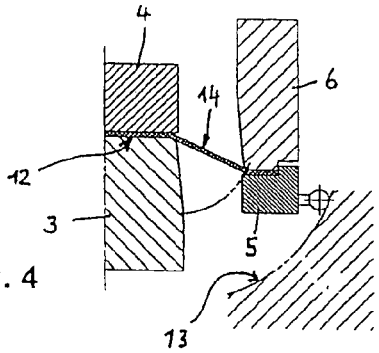

Next, the upper forming jaws 6 are moved to the closing position for securing the length sides 8 of the blank 7 between the forming jaws 5, 6, as shown in FIG. 3. The upper forming jaws 6 clamp the length sides 8 of the blank 7 between themselves and the lower forming jaws 6 in a precisely fixed position and firmly enough to prevent the blank 7 from shifting during the shaping process.

Prior to or in the initial phase of the shaping process, the blank 7 is clamped in midsection between the ram 3 and the hold-down clamp 4 of the press tool 2.

During the closing movement, the forming jaws 5, 6 are moved mechanically, e.g. via curved paths 13 (shown in FIG. 4), inclined planes, or the like, or by means of hydraulic or electric drives, inwards in a direction of the press tool 2 and vertically thereto, accompanied by a decrease in the distance "a", in the absence of a relative movement between the blank 7 and the forming jaws 5, 6. Slight excess material may be experienced in the clear regions 14 of the blank 7 that are not clamped. The upper forming jaws 6 are hereby locked or coupled with the upper forming jaws 6 in a formfitting or frictional manner so as to realize a joint inward movement of the forming jaws 5, 6. In other words, the forming jaws 5, 6 move in synchronism. This movement may, of course, also implemented or assisted, using separate servo drives.

Figure 5:
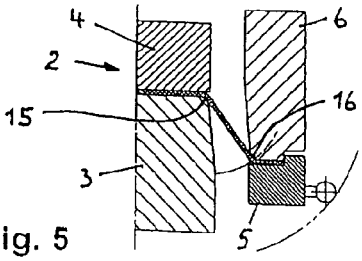

During the shaping process, as shown in FIG. 5, the blank 7 is bent via radiused shaped areas 15 on the ram 3 and via radiused shaped areas 16 on the upper forming jaws 6, in the absence of any significant relative movements between the ram 3 and upper forming jaws 6, on one hand, and the blank 7, on the other hand.

Figure 6:
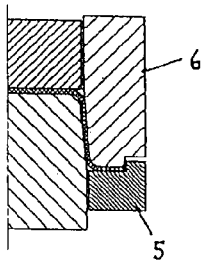
Figure 7:
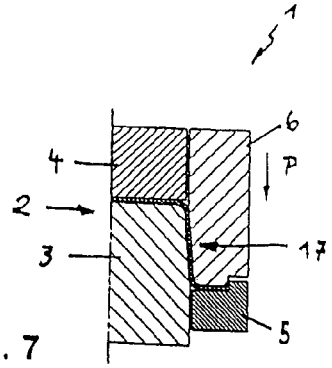

Just shy of the lower point of reversal of the die 1, the forming jaws 5, 6 reach their horizontal end position, as shown in FIG. 6. During further closing movement via the ram 3, the blank 7 is stretched, as indicated by arrow 7, and formed to final shape to produce the finished sheet metal part 17. This is shown in FIG. 7. The thus realized stretching of the material enables a compensation of possible fluctuations of the blank size and of deviations from the desired geometry, caused by wear or other reasons. The sheet metal part 17 has high quality with defined length sides and edges. No subsequent trimming along the length sides of the sheet metal part 17 is required. The positioning of the holes in the blank 7 in accurately maintained in the finished sheet metal part 17.

Figure 8:
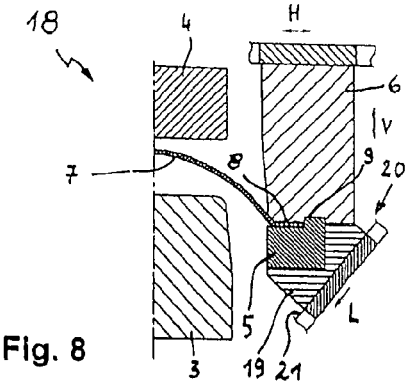
FIG. 8 illustrates schematically, in cross section, another die to carry out a process of making a sheet metal part in accordance with the present invention.

Referring now to FIG. 8, there is shown schematically, in cross section, another die, generally designated by reference numeral 18, to carry out a process of making a sheet metal part in accordance with the present invention. Parts of the die 18 corresponding with those of die 1 in FIG. 1 are denoted by identical reference numerals. The die 18 is also depicted here by way of its right side only. The die 18 also includes press tool 2 with lower ram 3 and upper hold-down clamp 4 as well as the outer lower and upper forming jaws 5, 6.

The blank 7 is received and clamped with its length sides 8 between the stops 9 in the lower forming jaws 5 and fixed in place by means of the upper forming jaws 6. Subsequently, the forming jaws 5, 6 are moved towards the press tool 2 and vertically thereto by means of a wedge-shaped slider 19 which is moved along a linear guide 20 on a slanted straight line 21. The general horizontal movement is indicated by arrow H whereas the vertical movement is indicated by arrow V. The linear downward movement of the forming jaws 5, 6 by means of the wedge-shaped slider 19 along the straight line 19 is indicated by arrow L.

In contrast to the process, as described with reference to FIGS. 1-7, the blank 7 in the variation of FIG. 8 is not clamped between the ram 3 and the hold-down clamp 4. Thus, as the forming jaws 5, 6 undergo the closing movement, the blank 7 bulges upwards and is shaped to final configuration to produce the finished sheet metal part by the forming jaws 5, 6 via the ram 3. This involves also the required stretching operation. During shaping, excess material may form between the participating shaping elements, i.e. forming jaws 5, 6 and ram 3, and can be eliminated during formation of the sheet metal part.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A method of making a sheet metal part for motor vehicles, comprising the steps of:

a) placing a blank with its opposite length sides between outer lower forming jaws of a die;

b) clamping the blank between stops on the outer lower forming jaws as the outer lower forming jaws move toward one another;

c) moving outer upper forming jaws to their closed position in a direction of the outer lower forming jaws, while the outer lower forming jaws remain stationary, to thereby secure the length sides of the blank between the lower and upper forming jaws in place;

d) moving the lower and upper forming jaws along an inwardly slanted line in a direction of a press tool; and e) shaping the blank to its final configuration to produce a sheet metal part.

2. The method of claim 1, wherein step d) includes the step of clamping a midsection of the blank in the press tool.

3. The method of claim 1, wherein step a) includes the step of securing the blank by pins in the lower forming jaws.

4. The method of claim 1, wherein the lower and upper forming jaws are moved along a curved path.

5. The method of claim 1, wherein the lower and upper forming jaws are moved along a straight line.

6. The method of claim 1, wherein step e) includes the step of stretching the sheet metal part.

7. The method of claim 1, wherein the upper and lower forming jaws are locked to one another for joint movement in relation to the press tool.

8. The method of claim 1, further comprising the steps of hot forming the sheet metal part in the press tool, and hardening the sheet metal part, at least in part.

9. The method of claim 1, further comprising the steps of cold forming the sheet metal part in the press tool.

10. The method of claim 1, wherein the blank is made of steel sheet.

11. The method of claim 1, wherein step b) includes the step of moving the lower forming jaws evenly inwards by a member selected from the group consisting of slider, hydraulic servo drive, and electric servo drive.

12. The method of claim 1, wherein step d) includes the step of shaping the blank about a ram of the press tool.

* * * * *